United States Patent [19]

Tromel

[11] 4,425,961

[45] Jan. 17, 1984

[54] CONTINUOUS CASTING PLANT FOR THE HORIZONTAL CONTINUOUS CASTING OF STEEL

[76] Inventor: Kristof W. Tromel, Am Roten Kreuz 19, 4005 Meerbusch, Fed. Rep. of Germany

[21] Appl. No.: 332,340

[22] Filed: Dec. 18, 1981

[30] Foreign Application Priority Data

Dec. 22, 1980 [DE] Fed. Rep. of Germany ..... 3048483

[51] Int. Cl.[3] ..... B22D 11/00

[52] U.S. Cl. ..... 164/440; 164/483

[58] Field of Search ..... 164/440, 439, 437, 483, 164/490, 488; 222/600

[56] References Cited

U.S. PATENT DOCUMENTS 977,271 11/1910 Callaghan ..... 222/600

1,088,171 2/1914 Pehrson ..... 164/440 X 3,752,218 8/1973 Gamble et al. ..... 164/440

3,903,955 9/1975 Antoine et al. ..... 164/440

4,340,110 7/1982 Honda et al. ..... 164/440 X

*Primary Examiner*—Kuang Y. Lin

*Assistant Examiner*—J. Reed Batten, Jr.

*Attorney, Agent, or Firm*—Holman & Stern

[57] ABSTRACT

This invention relates to a continuous casting plant for the horizontal continuous casting of steel, especially steel billets, the plant including a horizontally displaceable chill mould which is adapted to be connected to the pouring spout of a pouring vessel, shut-off means being also provided for isolating the mould from the pouring spout when it is desired to separate the mould from the pouring vessel. In accordance with the invention the shut-off means comprises a shear-plate which is slidable across the inlet of the mould.

7 Claims, 4 Drawing Figures

Figures 1, 2:
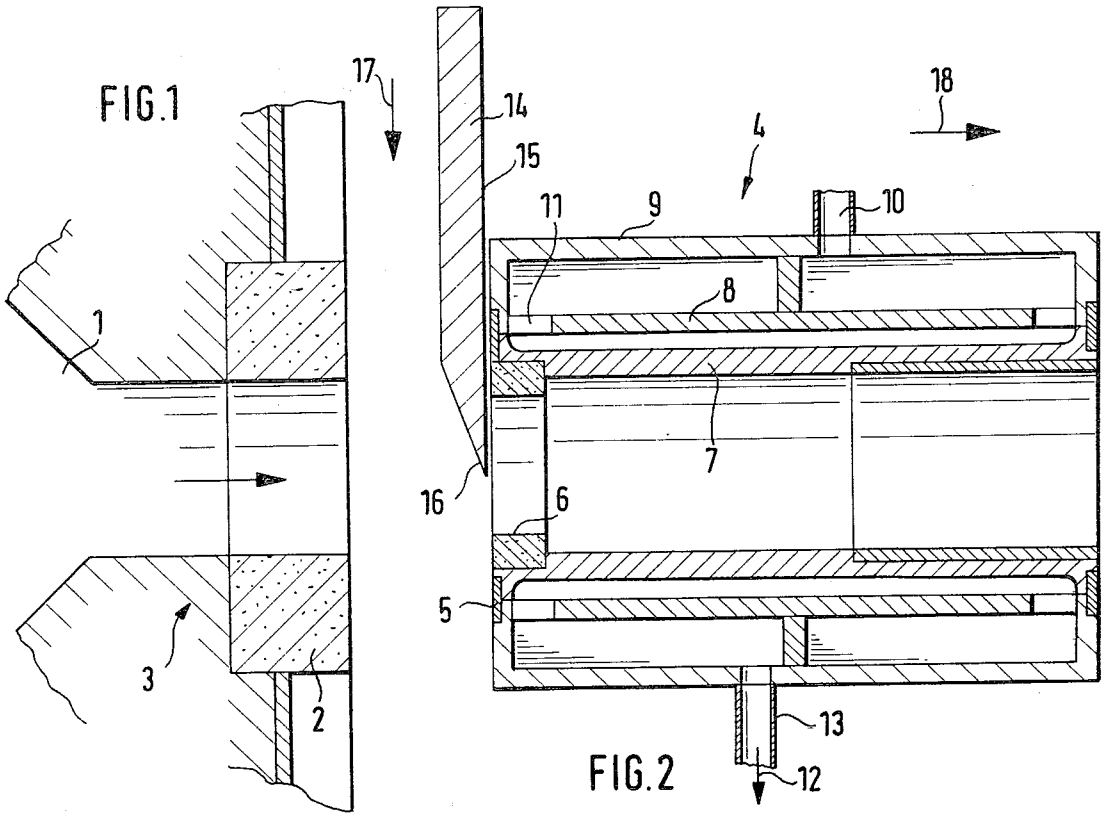

FIG. 3
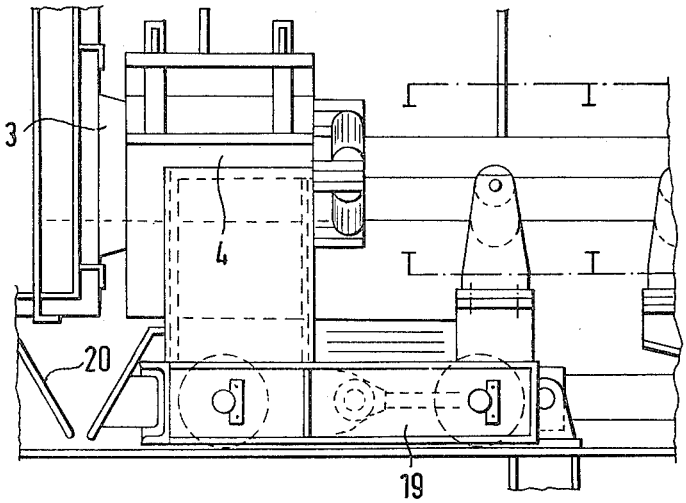
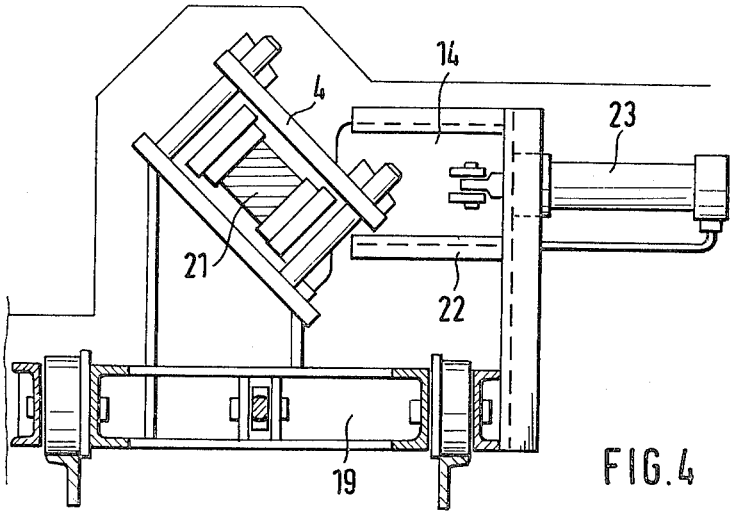
FIG. 4

CONTINUOUS CASTING PLANT FOR THE HORIZONTAL CONTINUOUS CASTING OF STEEL

This invention relates to a continuous casting plant for the horizontal continuous casting of steel, particularly billets, in which a horizontally displaceable chill mould is adapted to be joined up with a pouring spout arranged in the vicinity of the bottom of a pouring vessel, or tundish, and shut-off means are provided to isolate the mould from the pouring spout when the mould is to be separated from the pouring vessel.

A problem encountered with this type of continuous casting plant resides in that towards the end of the pouring process the mould is no longer completely filled, or, if a superficial crust has already begun to form in the pouring vessel, the liquid 'sump' which would have already entered the mould may flow back into the tundish. In either case the last poured end portion of the continuous casting, the actual size of which cannot be precisely predicted, will be unsound and useless.

It is the aim of the present invention to provide an improved continuous casting plant of the kind specified in which wholly sound and usable continuous castings can be made.

In accordance with the invention, there is provided a continuous casting plant for the horizontal continuous casting of steel of the kind comprising a horizontally displaceable chill mould having an inlet which in use is adapted to be connected to a pouring spout of a pouring vessel, and shut-off means which are adapted to isolate the mould from the pouring spout when desired, wherein the shut-off means comprises a shear-plate which keeps the mould inlet closed when the mould is displaced to separate it from the pouring spout.

Due to this provision pouring can be terminated while there is still enough molten steel in the tundish to ensure complete filling of the mould. Moreover, the molten steel, once it has entered into the mould, cannot flow back through the pouring spout because the shear-plate prevents all outflow from the mould when the latter has been driven away from the pouring spout.

In addition to this there is the further advantage that the pouring vessel or tundish can be completely drained after pouring so that no residues of frozen steel can be formed in the tundish which would have to be removed before the vessel could be used in a following pouring operation.

A particularly convenient position for the shut-off shear-plate is directly in front (as viewed in the direction of pouring flow) of a ring seal provided at the mould inlet. When arranged in this region the shear-plate can still rest against the cooled outside end wall of the mould whilst engaging the said ring seal.

Conveniently the shear-plate is connected to a truck which carries the mould and is jointly displaceable with said truck in the flow direction of the continuous casting. In addition to this the shear-plate is mounted for rapid displacement relative to the truck along a path one end of which corresponds to the closed, and the other to the open, condition of the mould. This displacement path is preferably at right angles to the flow direction of the continuous casting which enables the shear-plate to reach the effective shut-off position by the shortest possible route.

A further special feature of the present invention, designed to avoid the application of sudden shock loads to the shear-plate at the start of the shearing-off process due to the high speed of shear-plate displacement into the shut-off position, resides in that the shear-plate is mounted for sliding displacement in a direction which corresponds to a diagonal of the cross-section of the mould inlet and the corresponding casting, such cross-section being of generally rectangular form. In other words, the shear-plate will move across the mould inlet section at a point where mechanical resistance is initially low and increases only in a gradual manner. Thus the shear plate is conveniently arranged for horizontal movement across the inlet of the mould whilst the latter is disposed so that all its sides are inclined to the horizontal and vertical.

A further advantage is obtained by arranging the mould in this orientation because in such a position it is possible to have a gap space between mould and pouring spout which can be shut-off by the shear-plate with a minimum loss of metal.

The closing speed as well as the durability of the shear-plate can be improved further by providing the plate with a plane side wall on the side which faces the mould inlet and with a tapered leading edge on the opposite side, facing the pouring vessel or tundish. This means that at the start of the shut-off process only part instead of all of the cross-section of the shear-plate is being pushed into the gap and this also contributes to a more gradual, instead of a sudden-shock-like application of the full load.

According to another provision of this invention the movements of the shear-plate are controlled in synchronism with the movements of the mould-supporting truck, which allows the separation of the mould from the pouring vessel and the closing of the mould inlet to be achieved in the shortest possible time.

The invention will now be more particularly described with reference to the accompanying schematic drawings illustrating one example of an embodiment of the invention, in which:

FIG. 1 is a fragmentary sectional view of a pouring spout of a pouring vessel or tundish which can be used in association with a continuous casting plant in accordance with the invention, FIG. 2 is a longitudinal sectional view of one example of a continuous casting plant in accordance with the invention including a continuous billet-casting mould which has been separated from the pouring spout seen in FIG. 1 and of which the mould inlet is partially obturated by a shear-plate, FIG. 3 is a side view of the mould seen in FIG. 2 in close proximity with the pouring spout, and FIG. 4 is an end view of the arrangement seen in FIG. 3.

As shown in FIG. 1, a pouring vessel, or tundish 1 is provided with an apertured nozzle brick 2 which may be formed of a special sintered ceramic brick of the kind normally used for this application and which ensures a constant pouring or outflow section as well as in use a sealed connection or junction with the mould. The actual pouring spout 3 terminates flush with said nozzle brick and during pouring the mould 4 shown in FIG. 2 is brought up close to and sealed relative to the pouring spout 3 with the aid of a connector fitting 5 at the frontal end face surrounding the mould inlet and a ring seal 6 or gasket element fitted in the mould inlet from which the freezing shell of the casting can detach itself in the course of extraction of the continuous casting from the mould. The mould 4 comprises an inner wall 7, surrounded with clearance by an intermediate wall 8 and an outer wall 9, the latter being provided with a feed connection 10 for cooling water which can flow through suitable apertures into said clearance between walls 8 and 9 to cool the hot part of the mould, the water then flowing from said clearance through other apertures 11 and thence out of the mould in direction of arrow 12 through a cooling water outlet 13 on the opposite side of the mould to the inlet 10. As will be seen from FIG. 4, the mould is of generally rectangular form in cross-section and is tilted so that its sides are all inclined to the vertical and horizontal.

There is also provided a shear-plate 14 which is shown in FIG. 2 in a position in which it partially obturates the inlet of mould 4. This figure clearly shows a plane side 15 of the shear-plate facing the mould 4 and the tapered leading edge 16 of the shear-plate. The shear-plate is adapted to be displaced in the direction of arrow 17 (i.e. in a diagonal direction with reference to the cross-section of the mould) when the mould 4 is displaced in the direction of arrow 18 for its separation from the pouring spout 3. Both these movements occur at a very rapid speed.

As shown in FIG. 3, the mould 4 is carried by a truck 19 which during pouring keeps the mould 4 firmly pressed against the front of the pouring spout 3 nozzle for as long as the continued casting of sound billets is certain. However, as soon as a complete filling of the mould is no longer feasible, or if the molten sump begins to flow back to the pouring spout, the mould is driven rapidly away from the spout 3 with the aid of truck 19 (moved by any convenient and known means) and its inlet is closed by rapid movement of the shear-plate 14 as hereinbefore described. This leaves some molten steel inside the tundish 1 which can then be drained off through a funnel 20 at the base of the latter.

In FIG. 4, reference character 21 indicates the cross-section of a continuously cast billet in the mould. The figure also shows a guide means 22 for the shear-plate 14 which is connected to the truck 19 so as to move bodily therewith. An hydraulic cylinder 23 is connected to one end of shear-plate 14 to effect opening and closing movement thereof. This arrangement enables the shear-plate 14 to be displaced at a very rapid speed (and, as shown, in a horizontal direction) during the separation of the mould 4 from the pouring spout 3 and, due to the orientation (i.e. "tilted" attitude) of the casting on the one hand, and the tapered leading edge 16 of the shear-plate on the other hand, the amount of positive resistance which must be surmounted in moving the shear-plate to its fully closed position is reduced to a minimum. The movements of the shear-plate 14 and the truck 19 are synchronised in any convenient manner e.g. the hydraulic cylinder 23 is actuated at the same time as the known means for displacing the truck is actuated.

The continuous casting plant according to this invention, besides being suitable for the continuous casting of billets as hereinbefore described, may also be used for castings of any other form.

I claim:

1. A continuous casting plant for the horizontal continuous casting of steel of the kind comprising a horizontally displaceable chill mould of generally rectangular form in cross-section and having an inlet which in use is adapted to be connected to a pouring spout of a pouring vessel, and shut-off means which are adapted to isolate the mould from the pouring spout when desired, wherein the mould is mounted on a displaceable truck and the shut-off means comprises a shear-plate which keeps the mould inlet closed when the mould is displaced to separate it from the pouring spout, the shear-plate also being mounted on said displaceable truck and being slidable relative to said truck in a direction perpendicular to the length of the mould and wherein said shear-plate is slidable in a direction generally parallel to a diagonal of the cross-section of said mould.

2. A continuous casting plant according to claim 1, wherein a ring seal is provided at the mould inlet and is arranged sealingly to engage the shear-plate in the closed position of the latter.

3. A continuous casting plant according to claim 1, wherein the mould is disposed so that each of its four sides is inclined to the horizontal and the vertical.

4. A continuous casting plant according to claim 1, wherein the shear-plate is plane on its side facing the mould inlet and is provided with a tapered leading edge on the opposite side.

5. A continuous casting plant according to claim 1, wherein the slidable movement of the shear-plate is synchronised in relation to the displacement of the truck by means of which the mould is displaceable.

6. A continuous casting plant according to claim 1, wherein the shear-plate is slidable by means of a hydraulic cylinder.

7. A continuous casting plant according to claim 3, wherein the shear-plate is plane on its side facing the mould inlet and is provided with a tapered leading edge on the opposite side.

* * * * *